United States Patent [19]

Troup

[11] 4,216,913

[45] Aug. 12, 1980

[54] METHOD AND APPARATUS FOR ENHANCING THE DISTRIBUTION OF WATER FROM AN IRRIGATION SPRINKLER

[75] Inventor: Edward M. Troup, Mt. Baldy, Calif.

[73] Assignee: Rain Bird Sprinkler Mfg. Corp., Glendora, Calif.

[21] Appl. No.: 966,400

[22] Filed: Dec. 4, 1978

[51] Int. Cl.[2] ..... B05B 1/04

[52] U.S. Cl. ..... 239/594; 239/233; 239/601

[58] Field of Search ..... 239/230, 233, 589, 592, 239/594, 596, 597, 601, DIG. 1

[56] References Cited

U.S. PATENT DOCUMENTS

| | | | |
|---|---|---|---|
| 1,668,271 | 5/1928 | Fisk | 239/601 X |
| 1,922,259 | 8/1933 | Paradise | 239/597 X |
| 2,792,256 | 5/1957 | Sinex | 239/233 |
| 2,921,744 | 1/1960 | Falcetti | 239/594 X |
| 3,447,756 | 6/1969 | Lawrence, Jr. | 239/594 |

*Primary Examiner*—Robert B. Reeves
*Assistant Examiner*—Gene A. Church
*Attorney, Agent, or Firm*—Fulwider, Patton, Rieber, Lee & Utecht

[57] ABSTRACT

A method and apparatus for enhancing the distribution of water from an irrigation sprinkler is provided and includes a nozzle disposed at the end of a discharge tube on the sprinkler, which nozzle includes a frusto-pyramidal passage leading to a polygonal nozzle outlet, thereby generating a substantial secondary flow within the nozzle which provides the desired controlled fall-out of water over the entire range of the stream ejected by the sprinkler.

17 Claims, 7 Drawing Figures

METHOD AND APPARATUS FOR ENHANCING THE DISTRIBUTION OF WATER FROM AN IRRIGATION SPRINKLER

BACKGROUND OF THE INVENTION

This invention relates generally to irrigation sprinklers of the impact or reaction drive types, and more particularly, to a method and apparatus for enhancing the distribution of water from such sprinklers when operated at low pressures.

As is well known in the art, it is highly desirable for each impact or reaction driven sprinkler in a system to provide an even distribution of water over its entire range of throw. Toward this end, it is important that the stream of water emitted by the sprinkler be comprised of at least some droplets of a very small size which will tend to fall out of the stream at a relatively short distance from the sprinkler. Slightly larger droplets fall out of the stream at a greater distance from the sprinkler. Accordingly, by controlling the droplet sizes emitted by the sprinkler, the distribution over the entire range of the sprinkler can be controlled.

One way this has been accomplished is by providing water to the sprinklers at relatively high pressures so the sprinklers produce a spray of water consisting of droplets of relatively small size. Typically, for a given sprinkler and nozzle size, there is a minimum pressure above which water must be supplied to the sprinkler to achieve satisfactory water distribution and sprinkler operation.

By way of example, as shown in the 1977—1978 Irrigation Equipment Catalog published by Rain Bird Sprinkler Mfg. Corp. of Glendora, Calif., for a full circle Model 30 sprinkler with a nozzle size of 3/16 inch, a minimum supply pressure of 45 pounds per square inch (psi) is required to achieve satisfactory water distribution and sprinkler operation. If the pressure is allowed to fall below this required level, the droplet size of the spray increases dramatically, and the distribution pattern will deteriorate appreciably.

When the spray is comprised of large droplets, a high percentage of the water is concentrated at the outer edges of the spray pattern, and when the large droplets fall to the ground, they tend to pack the soil, thereby decreasing its permeability to water. This decreased permeability causes loss of water from run off and evaporation before the water can be absorbed into the soil.

Another method which has been attempted for achieving the desired distribution of water is by ejecting the stream through a non-circular orifice mounted on the sprinkler. In this way, a secondary flow is created within the stream which forms a number of fins of fine spray breaking away from the main stream of water ejected from the sprinkler.

This phenomenon was reported in an article by W. A. Hall and P. A. Boving entitled "Non-Circular Orifices For Sprinkler Irrigation", published in the January, 1956 edition of *Agricultural Engineering*. Hall and Boving formed the non-circular orifice in an 0.015 inch thick brass ring held in a conventional ring clamp mounted at the end of a sprinkler discharge tube. Although some desirable effects were observed, it was reported that at a relatively low pressure, practically zero fall out occured over about the first one-quarter of the range of the sprinkler. When higher pressure was employed, and undesirable susceptibility to wind drift was observed.

The work of Hall and Boving was expanded upon and further reported in a doctoral thesis submitted to the Department of Agricultural Engineering at Michigan State University in 1956 by Walter K. Bilanski. In that thesis, Bilanski concluded that an equilateral triangular orifice produced the best distribution results when the length of the triangular conduit leading to the orifice extended for a considerable depth into the nozzle. It is believed that the relatively long non-circular passage was required in order to develop a substantial secondary flow within the stream. Although the non-circular orifices described by Bilanski produced the desired distribution of water, the relatively long, straight, non-circular passage creates a significant pressure drop in the nozzle, and it is therefore necessary to supply the irrigation water at a relatively high pressure for proper operation of the sprinkler.

It will be appreciated that large amounts of energy are required to maintain the supply pressure necessary for proper operation of the above described sprinklers. In the well known pivot move type sprinkler systems, for example, it is often necessary to provide high capacity supply pumps typically run by natural gas or electricity, and often even booster pumps along the supply line in order to maintain the required pressure. The cost of the energy consumed by high capacity supply pumps, in addition to the booster pumps, significantly increases the cost of operating such sprinkler systems.

Accordingly, there exists a need for a convenient, effective and economical device for enhancing the water distribution from sprinklers which is capable of operating at energy saving low pressures. As will become apparent from the following, the present invention satisfies that need.

SUMMARY OF THE INVENTION

The present invention resides in a new and improved nozzle and method of operation for use in irrigation sprinklers of the impact and reaction drive types and by which water may be evenly distributed over the range of the sprinkler even when operating at relatively low supply pressures. This is accomplished generally by a new and improved nozzle in which the stream of water flowing through the sprinkler converges in a pyramidally shaped passage and is released from the nozzle through a polygonal orifice formed at the end of the pyramidal passage. While flowing through the pyramidal passage a substantial secondary flow is developed which causes the stream ejected from the nozzle to include a number of fins comprised of relatively small droplets of water to break away from the main stream of water. In this way, the desired distribution of water is achieved, and the sprinkler can be operated at a relatively low supply pressure.

More specifically, the nozzle of the present invention is arranged to be mounted adjacent the discharge end of a sprinkler discharge tube, and includes a generally cylindrical inlet sized to receive water from the discharge tube. The pyramidal passage leads from the cylindrical inlet to the polygonal orifice, and preferably forms a frustum of a right regular pyramid. An equilateral triangular or square right pyramid are preferred, but it will be appreciated that other shapes can also be employed. In accordance with the method of the invention, a substantial secondary flow is developed as the stream converges in the pyramidal passage, which flow causes the stream to be evenly distributed over the entire range of the sprinkler.

Other features and advantages of the present invention will become apparent from the following detailed description, taken in conjunction with the accompanying drawings, which illustrate, by way of example, the principles of the invention.

DETAILED DESCRIPTION

Figure 1:
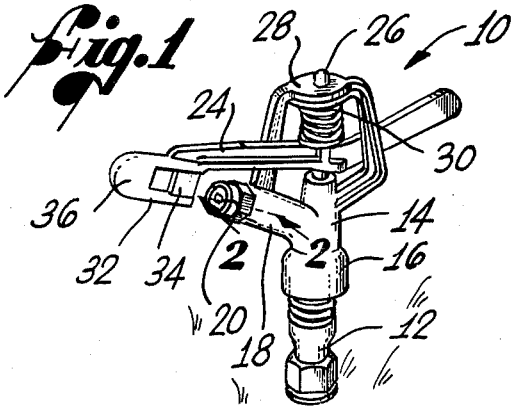
FIG. 1 is a perspective view of a nozzle embodying the present invention, and illustrated assembled on a conventional sprinkler of the impact drive type.

As shown in the exemplary drawings, the present invention is embodied in a nozzle for use with an irrigation sprinkler of the impact or reaction drive type, and herein is shown in the drawings as an impact drive sprinkler, indicated generally by reference numeral 10 in FIG. 1. In this instance, the sprinkler 10 is mounted for rotation about a vertical axis on a water supply pipe or riser 12, and includes a main body 14 having a lower inlet portion 16. Extending upwardly and outwardly from the inlet portion 16 of the body 14 is a discharge tube 18 having an internal conduit 20 (FIG. 2) through which water travels to a nozzle 22.

When in use, water is admitted under supply pressure into the sprinkler 10 through the riser 12, and travels through the internal conduit 20 in the discharge tube 18 to the nozzle 22. The nozzle 22 ejects the water upwardly and outwardly away from the sprinkler 10, the distance of throw being a function of sprinkler and nozzle size, and the supply pressure of the water admitted to the sprinkler.

To drive the sprinkler 10, an impact arm 24 herein is mounted for rotation about a vertical axis on a pin 26 upstanding from the body 14 and supported at its upper end by a bridge portion 28 integrally formed with the body 14. The arm 24 is biased by a spring 30 to the position shown in FIG. 1, and includes a drive spoon 32 having an inner water deflecting vane 34 and an outer water deflecting portion 36 disposed at one end of the arm.

The operation of the impact arm 24 to drive the sprinkler 10 is well known in the art, and it is not believed necessary to describe that operation in detail here. It is sufficient for the purposes of this invention to point out that during the operation of the sprinkler 10, the water deflecting vane 34 and portion 36 intermittently enter the stream of water emitted from the nozzle 22 causing the arm 24 to impact against the bridge portion 28 of the body 14, thereby imparting the sprinkler 10 an increment of rotational movement.

In accordance with the present invention, the nozzle 22 of the sprinkler 10 is arranged to enhance the distribution of water over the entire range of the sprinkler 10 by providing a frusto-pyramidal passage 40 (FIG. 2) leading to a polygonal nozzle outlet 42, thereby generating a substantial secondary flow within the nozzle. Further, the even distribution of water is achieved when operating at a relatively low supply pressure, and the stream ejected form the nozzle 22 of the present invention is capable of driving an impact or reaction drive sprinkler in a reliable and effective manner while operating at low pressures.

In order to retain the nozzle 22 in position adjacent the end of the discharge tube 18, the nozzle 22 is received in one end of a cylindrical housing 44 having a wall 46 which is disposed around the nozzle 22, and which has its outer end crimped or rolled over the outer end of the nozzle 22, as shown at 48, in order to hold the nozzle 22 firmly within the housing. The housing 44 is herein threadably received in the downstream end of the conduit 20, and includes an internal passage 50 sized to substantially correspond with the internal diameter of the conduit 20.

Figure 2:
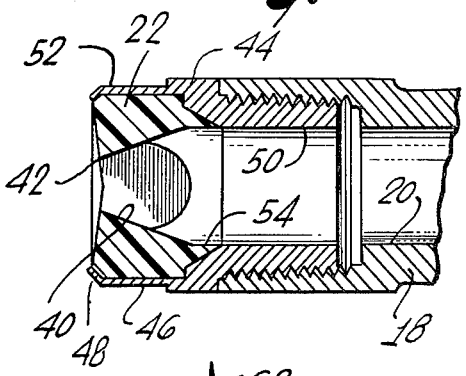
FIG. 2 is an enlarged, fragmentary, cross-sectional view of a nozzle of the present invention and taken substantially along line 2—2 of FIG. 1.
Figure 3:
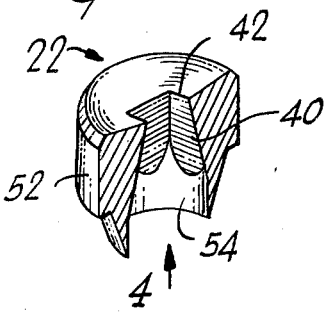
FIG. 3 is a fragmentary perspective view of the nozzle of FIG. 2, and illustrating a right square pyramidal passage leading to a square nozzle outlet.

As can best be seen in FIGS. 2 and 3, the nozzle 22, which herein is shown formed of a moldable plastic material, includes a generally cylindrical body having an external surface 52 sized to cooperate with the cylindrical housing 44. To receive the stream of water flowing through the conduit 20, the nozzle 22 has a generally cylindrical inlet 54 having an inside diameter substantially equal to the inside diameter of the passage 50, and the inlet 54 conducts the stream to the frusto-pyramidal passage 40. In this instance, the passage 40 is shown as a frustum of a right square pyramid, and accordingly, the outlet 42 is a square.

Figure 4:
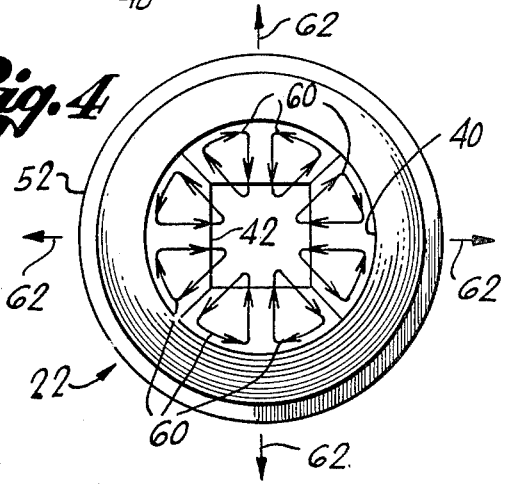
FIG. 4 is a further enlarged end view of the nozzle of FIGS. 2 and 3, taken generally in the direction of line 4 in FIG. 3, and illustrating the direction of secondary flow developed in the nozzle.

As can best be seen in FIG. 4, a component of secondary flow is generated in the passage 40, and the direction of that flow is indicated by the arrows 60. It will be appreciated that the magnitude of flow in the direction indicated by the arrows 60 is relatively small when compared to the magnitude of axial flow through the nozzle, but the secondary flow generated in the passage 40 is significant enough to achieve the desired even distribution of water over the range of the sprinkler.

As discussed in the above mentioned thesis of Bilanski, the secondary flow generated in a non-circular conduit tends to flow radially toward the corners of the conduit, peripherally toward the center of each wall of the conduit, and back toward the center of the conduit in a direction generally perpendicular to each wall. In the nozzle structure of the present invention, the secondary flow commences at the beginning of the pyramidal passage 40, and accelerates throughout the passage to the outlet 42.

Upon being released from the nozzle 22, a fin of water comprised of relatively small droplets breaks radially away from the unconstrained stream at approximately the midpoint of each side of the polygonal outlet 42. The direction of these fins is illustrated by the arrows 62 in FIG. 4. The above mentioned article of Hall and Boving attributes this phenomenon to ". . . the differences in direction of motion of the individual elements [of the stream]," and it is generally believed that this phenomenon is a result of the secondary motion generated in the stream by flowing through a non-circular conduit.

Figure 5:
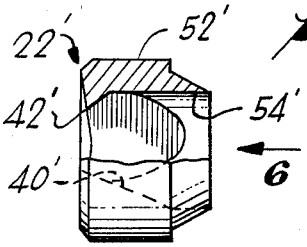
FIG. 5 is a fragmentary, partly sectional, elevational view of an alternative nozzle embodying the present invention, and illustrating a right, equilateral triangular, pyramidal passage leading to an equilateral triangular nozzle outlet.
Figure 6:
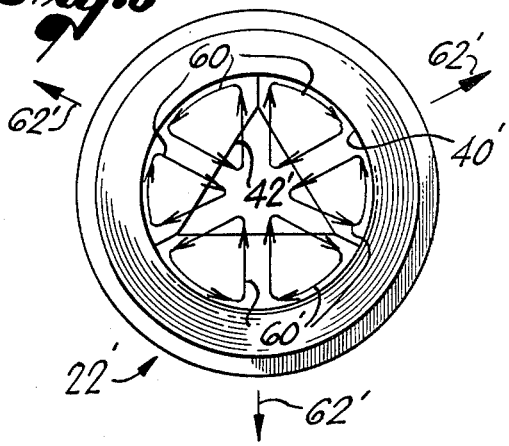
FIG. 6 is an enlarged end view of the nozzle of FIG. 5, taken generally in the direction of line 6 in FIG. 5, and illustrating the direction of secondary flow within the nozzle.

An alternative embodiment of the nozzle of the present invention is illustrated in FIG. 5. In this instance, the nozzle 22' is similar to that previously discussed in connection with FIGS. 1 through 4, and parts of the nozzle of FIGS. 5 and 6, which find substantial correspondence in structure and function to those previously discussed in connection with FIGS. 1 through 4, have been designated with corresponding primed reference numerals.

The nozzle 22' is arranged to be received in the housing 44 in the same manner as the nozzle 22, and differs from the nozzle 22 only in that the frusto-pyramidal passage 40' is a frustum of a right equilateral triangular pyramid, and the outlet 42' is an equilateral triangle. As can best be seen in FIG. 6, the direction of the secondary flow through the nozzle 22' is again radially outward toward the corners of the passage 40', peripherally toward the center of each wall of the passage, and back toward the center of the nozzle in a direction generally perpendicular to each wall, as indicated by the arrows 60' in FIG. 6. Upon release from the triangular outlet 42', three fins of fine spray break away from the main stream, each in a direction generally perpendicular to one side of the outlet, as indicated by the arrows 62' in FIG. 6.

Other polygonal shapes can be used to practice the method of this invention. However, as the number of sides is increased, the intensity of secondary flow decreases, approaching zero as encountered in a circular conduit. Accordingly, the equilateral triangular and square configurations described are preferred, but it will be appreciated that nozzle configurations having more than four sides will also enhance the distribution of water over the range of the sprinkler, albeit to a lesser degree. Although square and equilateral triangular shapes have been described, generally rectangular and triangular shapes are also suitable for the purposes of this invention. Further, in order to control the trajectory of the stream as well as the distribution of water, the nozzle 22 can be formed with a pyramidal passage 40 having a longitudinal axis which is not parallel to the axis of the discharge tube 18.

Figure 7:
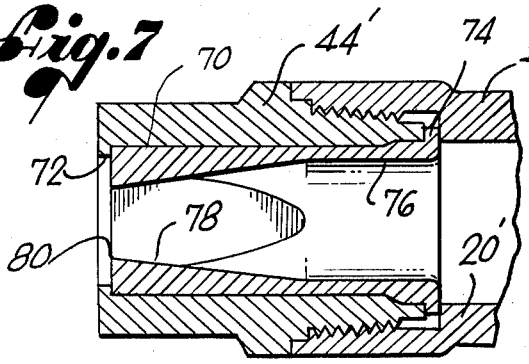
FIG. 7 is a fragmentary cross-sectional view illustrating another alternative embodiment of the present invention.

Another alternative embodiment of the present invention is illustrated in FIG. 7, and includes a nozzle 70 retained at the discharge end of a sprinkler discharge tube 18'. Again, primed reference numerals are employed to designate parts which have a structure and function similar to parts previously discussed.

In this instance, the nozzle 70 is received in the upstream end of a housing 44' which is threadably retained at the end of the discharge tube 18' and in communication with the conduit 20'. The nozzle is arranged to abut an inwardly directed flange 72 at the downstream end of the housing 44', and the nozzle is securely retained adjacent the outlet of the conduit 20' by having an outwardly directed flange 74 clamped between the housing 44' and the end of the discharge tube 18'. In this way, a generally cylindrical inlet 76 of the nozzle 70 is held in communication with the conduit 20' and leads to a frusto-pyramidal passage 78 ending in a polygonal outlet 80. The passage 78 is herein illustrated as being a frustum of a right square pyramid, but as described above, it will be appreciated that other configurations can also be employed.

It has been determined that satisfactory operation of the nozzles of the present invention is achieved when sufficient axial length is provided through the frusto-pyramidal passage of the nozzle to generate a fully developed secondary flow pattern. More specifically, satisfactory results have been achieved when the angle formed by each wall of the pyramidal passage with respect to the longitudinal axis of the nozzle is between about 7½ and 22½ degrees.

Comparative tests between the nozzle of the present invention and a nozzle constructed in accordance with the Bilanski disclosure indicate that the nozzle of the present invention has a 25% to 30% greater range, accompanied by a more uniform distribution, when operated at the same pressure. When compared to a standard straight bore circular nozzle, the nozzle of this invention has a range loss of only 5% to 10%, and a greatly enhanced distribution of water.

From the foregoing, it will be appreciated that the nozzle of the present invention provides a method and apparatus for achieving a desirable even distribution of water over the entire range of a sprinkler while operating at energy saving low supply pressures. Further, the nozzle of this invention can be fabricated conveniently and economically, for example of moldable plastic, does not significantly decrease the range of conventional straight bore nozzles, and is adaptable for use with substantially any conventional sprinkler of the impact of reaction drive type.

While several particular forms of the invention have been illustrated and described, it will also be apparent that various modification can be made without departing from the spirit and scope of the invention.

I claim:

1. A nozzle for generating a substantial secondary flow in a stream of water being ejected from an irrigation sprinkler of the impact or reaction drive type, said nozzle comprising:

a generally tubular body having an aperture therethrough for receiving a stream of water supplied to said sprinkler;

said aperture including a plurality of interior walls defining a frusto-pyramidal passage, said passage being of sufficient axial length to generate said substantial secondary flow in said stream of water; and said frusto-pyramidal passage terminating in a polygonal outlet from said nozzle, thereby enhancing the distribution of water ejected from said sprinkler.

2. A nozzle as set forth in claim 1 wherein said frusto-pyramidal passage is a frustum of a right rectangular pyramid, and said polygonal outlet is a rectangle.

3. A nozzle as set forth in claim 2 wherein said pyramid is a right square pyramid, and said outlet is a square.

4. A nozzle as set forth in claim 1 wherein said frusto-pyramidal passage is a frustum of a right triangular pyramid, and said polygonal outlet is a triangle.

5. A nozzle as set forth in claim 4 wherein said right triangular pyramid is an equilateral right triangular pyramid, and said outlet is an equilateral triangle.

6. A nozzle as set forth in claim 1 wherein said nozzle is formed of a moldable plastic material.

7. A nozzle as set forth in claims 3 or 5 wherein each of said interior walls forms an angle with longitudinal axis of said nozzle, said angle being between about 7½ and 22½ degrees.

8. In an irrigation sprinkler having a body including a range tube projecting therefrom, said tube including a generally cylindrical conduit for conducting a stream of irrigation water to nozzle disposed adjacent a discharge end of said tube; the improvement wherein said nozzle comprises:

a generally tubular body having an aperture therethrough for receiving said stream of water from said cylindrical conduit and conducting said stream through and out of said nozzle;

said aperture including a first generally cylindrical portion adapted to be disposed adjacent said discharge end of said tube and having an inside diameter substantially equal to the inside diameter of said conduit; and said aperture further including a plurality of generally flat interior walls forming a frustum of a right regular pyramid, said pyramid converging from said cylindrical portion of said aperture to a regular polygonal outlet from said nozzle, and said pyramid being of sufficient axial length to generate a substantial secondary flow in said stream of water conducted through said nozzle, thereby enhancing the distribution of irrigation water conducted out of said nozzle.

9. The improvement as set forth in claim 8 wherein said pyramid is a square pyramid, and said outlet from said nozzle is a square.

10. The improvement as set forth in claim 8 wherein said pyramid is an equilateral triangular pyramid, and said outlet from said nozzle is an equilateral triangle.

11. The improvement as set forth in claims 9 or 10 wherein each of said interior walls forms an angle with a longitudinal axis of said nozzle, said angle being between about 7½ and 22½ degrees.

12. A method of generating a substantial secondary flow in a stream of water ejected from an irrigation sprinkler of the impact or reaction drive type, said method comprising the steps of:

supplying a generally cylindrical stream of pressurized water to a nozzle mounted on said sprinkler;

converging said stream in a frusto-pyramidal passage within said nozzle along an axial distance sufficient to generate a substantial secondary flow within said stream; and releasing said stream from a polygonal outlet of said nozzle, said outlet forming one end of said frusto-pyramidal passage, thereby enhancing the distribution of water ejected from said sprinkler.

13. A method as set forth in claim 12 wherein said frusto-pyramidal passage is a frustam of a right rectangular pyramid, and said polygonal outlet is a rectangle.

14. A method as set forth in claim 13 wherein said pyramid is a right square pyramid, and said outlet is a square.

15. A method as set forth in claim 12 wherein said frusto-pyramidal passage is a frustum of a right triangular pyramid, and said polygonal outlet is a triangle.

16. A method as set forth in claim 15 wherein said right triangular pyramid is an equilateral right triangular pyramid, and said outlet is an equilateral triangle.

17. A method as set forth in claims 14 or 16 wherein said stream is converged toward a longitudinal axis of said stream at an angle of between about 7½ and 22½ degrees.

* * * * *